US011052401B2

(12) United States Patent
Chen

(10) Patent No.: US 11,052,401 B2
(45) Date of Patent: Jul. 6, 2021

(54) BALL MILL LINER ASSEMBLY AND INSTALLATION METHOD THEREOF

(71) Applicant: Xuzhou Qiaoxin Mining Machinery Manufacturing Co., Ltd., Xuzhou (CN)

(72) Inventor: Chen Chen, Xuzhou (CN)

(73) Assignee: Xuzhou Qiaoxin Mining Machinery Manufacturing Co., Ltd., Jiangsu (CN)

( * ) Notice: Subject to any disclaimer, the term of this patent is extended or adjusted under 35 U.S.C. 154(b) by 518 days.

(21) Appl. No.: 15/100,632

(22) PCT Filed: Nov. 26, 2014

(86) PCT No.: PCT/CN2014/092233
§ 371 (c)(1),
(2) Date: May 31, 2016

(87) PCT Pub. No.: WO2015/081800
PCT Pub. Date: Jun. 11, 2015

(65) Prior Publication Data

US 2016/0303574 A1 Oct. 20, 2016

(30) Foreign Application Priority Data

Dec. 3, 2013 (CN) ..... 201310645483.6

(51) Int. Cl.
*B02C 17/22* (2006.01)

(52) U.S. Cl.
CPC ..... *B02C 17/22* (2013.01); *B02C 17/225* (2013.01); *B02C 2210/02* (2013.01)

(58) Field of Classification Search
CPC ..... B02C 17/22; B02C 17/225; B02C 2013/2825; B02C 13/282
(Continued)

(56) References Cited

U.S. PATENT DOCUMENTS 2,362,811 A * 11/1944 Fitzgerald ..... B02C 17/22 241/183
2,743,060 A * 4/1956 Daman ..... B02C 17/22 241/183

(Continued)

FOREIGN PATENT DOCUMENTS

CN 2759593 Y * 2/2006 ..... B02C 17/22
CN 2905212 * 5/2007 ..... B02C 17/22
CN 201848281 * 6/2011 ..... B02C 17/22

OTHER PUBLICATIONS

Gong, Translation: CN 2905212 (Year: 2007).*
Dai, Translation: CN 201848281 (Year: 2011).*
Bao, Translation of CN-2759593-Y (Year: 2006).*

*Primary Examiner* — Adam J Eiseman
*Assistant Examiner* — Bobby Yeonjin Kim
(74) *Attorney, Agent, or Firm* — Proi Intellectual Property US; Klaus Michael Schmid

(57) ABSTRACT

A ball mill liner assembly and installation method thereof; the ball mill liner assembly comprises wear-resistant liners (1), installation modules (3) and self-fixing liners (2); the self-fixing liners are made of ductile materials such as carbon steel or low-carbon alloy steel; the wear-resistant liners are integrally made of ceramic material; self-fixing liners are installed between a plurality of wear-resistant liners, and installation modules made of low-carbon alloy steel are used adjacent to the self-fixing liners.

6 Claims, 2 Drawing Sheets

(58) Field of Classification Search
USPC ..... 241/182, 183
See application file for complete search history.

(56) References Cited

U.S. PATENT DOCUMENTS 3,378,209 A * 4/1968 Crocheron ..... B02C 17/225
241/102
3,804,346 A * 4/1974 Norman ..... B02C 17/225
241/182
3,873,035 A * 3/1975 Benson ..... B02C 18/0084
241/100
4,243,182 A * 1/1981 Dugger, Jr. ..... B02C 17/22
241/153
4,936,519 A * 6/1990 Pichlmaier ..... B02C 17/22
241/183
5,472,148 A * 12/1995 Schaeffer ..... B02C 17/225
241/183
6,036,127 A * 3/2000 Moller ..... B02C 17/225
241/183
6,206,310 B1 * 3/2001 Schneider ..... B02C 17/22
241/299

* cited by examiner

BALL MILL LINER ASSEMBLY AND INSTALLATION METHOD THEREOF

CROSS-REFERENCE TO RELATED APPLICATIONS

This application claims priority from CN Application No. CN201310645483.6, filed Dec. 3, 2013 and PCT Application No. PCT/CN2014/092233, filed Nov. 26, 2014, the contents of which are incorporated herein in the entirety by reference.

FIELD OF THE INVENTION

The invention relates to a ball mill liner, in particular to a ball mill liner assembly and installation method thereof.

BACKGROUND OF THE INVENTION

Ball mills are main grinding equipment used in the mine, cement, electric power and chemical industries, etc. By now, ball mill liners are still mainly made of metal and partially made of rubber under two-section and three-section conditions. According to the statistics, the national annual consumption of metal liners is about 600,000 t, wherein the main metal material is iron. Iron is a kind of finite resource owned by the human beings, in particular in China, iron mines are barren with high mining costs and serious environmental pollution; the main issues on metal liners are heavy weight, severe wear, high metal consumption, high operating cost, high operating energy consumption of ball mills, poor working environment and large maintenance load; metal liners have a high production energy consumption and generate environmental pollution such as waste sand and exhaust in the production process; in the cement industry, metal inclusions caused by wear of metal liners will reduce the cement quality; in the food and pharmaceutical industries, metal liners will bring heavy metal pollution with great hazards; in the mine industry, usage and maintenance of metal liners is one of main factors influencing the output and the production cost; under a few of working conditions, although rubber liners reduce some costs, their service life is shorter than that of metal liners and the elasticity of rubber results in production drawdown of 10%; therefore, a ball mill liner assembly and installation method thereof is urgently required to solve the aforementioned issues.

SUMMARY OF THE INVENTION

The invention puts forward a ball mill liner assembly and installation method thereof, which overcomes the shortcomings and problems in the existing technologies, prolongs the service life, improves the grinding efficiency and reduces the energy consumption and costs.

The applicant puts forward that the ball mill involved in the ball mill liner assembly is grinding equipment instead of crushing equipment, and the theory of less crushing and more grinding is the fundamental solution to improve the production efficiency and reduce the wear. With application of the pre-crushing technology, the crushing section is arranged before grinding, the feeding size is reduced, and the ball mill works as professional grinding equipment gradually. While in the traditional theory, the gradation of the mill balls and the large-diameter mill balls and ball mill crushing section have a significant negative impact on improving the production efficiency and reducing the wear.

The applicant finds through research that the large-dimension mill ball (with a diameter of larger than 40 mm) in the traditional ball mill gradation fails to generate an effective grinding on the feeding particles (with a diameter of 1 mm or below) of the ball mill with pre-crushing technology before grinding and causes serious damages to the liners; therefore, the applicant puts forward a ball mill liner assembly. Due to the previous pre-crushing technology and the dimension of the mill ball configured below 40 mm, it is possible to use ceramic liners. The invention prolongs the service life of the mill liners, reduces the replacement and maintenance load of mill liners, improves the production efficiency of the enterprise and effectively reduces the operating energy consumption of the ball mill; in the cement industry, application of ceramic materials can prevent metal pollution to the metal liners and improve the quality of cement.

The technical issues of the invention are solved through the following technical scheme: A ball mill liner assembly, fitted into the ball mill drum, wherein comprising a plurality of wear-resistant liners and self-fixing liners alternately fitted into the inner wall of the drum; the wear-resistant liners are integrally made of ceramic materials and the self-fixing liners are made of ductile materials; the plurality of wear-resistant liners and self-fixing liners are assembled along the circumferential direction of the ball mill drum to form a circle; multiple assembled circles towards the axial line direction of the ball mill drum form the working face of the ball mill. When the ball mill works, the self-fixing liners bear the materials and the pressure radially applied by the balls along the ball mill drum and extend circumferentially, thus making the connection firmer with the wear-resistant liners in the ball mill drum.

Further design lies in that it also comprises installation modules. The wear-resistant liner is shaped in a circular arc adapted to the inner wall of the ball mill drum. The side fitted to the inner wall of the drum is a smooth surface or a hollow surface, while the other side is the working face. The working face is integrally in the shape of waves distributed along the circumference of the drum and a plurality of grooves for guiding the movement of the mill balls are uniformly arranged along the axial direction of the drum; a plurality of self-fixing liners are fully uniformly arranged on the circumference of the ball mill drum upwards at intervals, a group of wear-resistant liners and installation modules are filled between two adjacent self-fixing liners, the self-fixing liners and wear-resistant liners are arranged with two lug bosses to form the lug boss ends at the same direction end face along the circumference of the drum, their sides opposite to the lug boss ends are planes; a side of the installation module is connected with the plane end of the wear-resistant liner, the self-fixing liner is connected with the end of the wear-resistant liner with the lug boss, the lug boss end of the self-fixing liner is fitted against the other side of the installation module; the wear-resistant liner and the self-fixing liner form two-point extrusion contact connection with each adjacent self-fixing liner and installation module through each lug boss end, thus enabling firm matching between the liners; a hard gasket is arranged between each self-fixing liner and installation module through interference insertion, thus enabling adequate extrusion contact among the wear-resistant liner, the self-fixing liner and the installation module and preventing the gasket of the installation module from damaging the self-fixing liner due to interference extrusion.

Further improvement lies in that the self-fixing liner has screw holes.

Further improvement lies in that the lug boss has oblique angles or circular arcs at both sides along the axial direction of the ball mill drum.

Further improvement lies in that the installation module is made of low-carbon alloy steel or steel plates.

Further improvement lies in that the self-ductile material is low-carbon alloy steel or carbon steel. An installation method of ball mill liner assembly, comprising the following steps to:

firstly use the self-fixing liners to divide the drum into several areas properly along the circumferential direction of the ball mill drum and utilize the existing screw holes of the ball mill drum to fix the self-fixing liners;

place the wear-resistant liner into the self-fixing liner division area in the ball mill drum circumferentially;

place the installation module above the lug boss on the self-fixing liner, enabling it to contact the end of the self-fixing liner with the lug boss and contact the end of the wear-resistant liner without the lug loss;

insert an iron wedge into the gap between the self-fixing liner and the installation module and hammer the iron wedge to fasten the liners at both sides along the circumferential direction; meanwhile, insert the gasket into the gap between the self-fixing liner and the installation module to realize tight fit among the liners in the whole area; then withdraw the iron wedge.

The invention uses ceramic materials to replace metal. Under the working condition of adjusting the maximum dimension of the mill ball in the ball mill properly, the ceramic liners can be applied to ball mills reliably and firmly. The service life of ceramic liners can reach 4-6 times of that of metal liners, which greatly improves the production efficiency of the enterprises and reduces the production costs. Since the ceramic density is only 38.5% of metal density, the weight of the whole liner only accounts for about 40% of the metal liner. Application of ceramic liners can reduce the operating energy consumption of ball mills. In the cement industry, application of ceramic materials can prevent metal pollution of metal liners and improve the quality of cement. Ceramic liners can be used to improve the working environment effectively and reduce the noises greatly. In the production process, ceramic liners can eliminate the environmental pollution such as waste sand and exhaust arising from production of traditional metal liners, reduce the production energy consumption greatly and meanwhile avoid consumption of much metal and expensive alloy elements to a great extent. Application of ceramic materials will reduce the national environment and energy costs greatly. In addition to improving the production efficiency of the enterprise greatly, the invention will also bring huge economic benefits and save resources.

The invention adopts the installation method of ball mill liner assembly to tightly fit the liners effectively and prevent the ceramic liners from breakage during pressing.

The invention adopts the no-bolt design and the installation form of assembling, which prevents the screw hole from becoming the stress center of the liner and resulting in cracks or cracking of the liner, solves the issue of applying high-hardness and low-ductileness wear-resistant materials to liners and solves the issues such as breakage of bolts of traditional bolted liners, powder and material leakage, shutdown, environmental pollution and heavy and complicated installation methods, thus greatly reducing the maintenance load of traditional bolted liners and further improving the production efficiency and working environment of the enterprise.

DETAILED DESCRIPTION OF PARTICULAR EMBODIMENTS OF THE INVENTION

Figure 1:
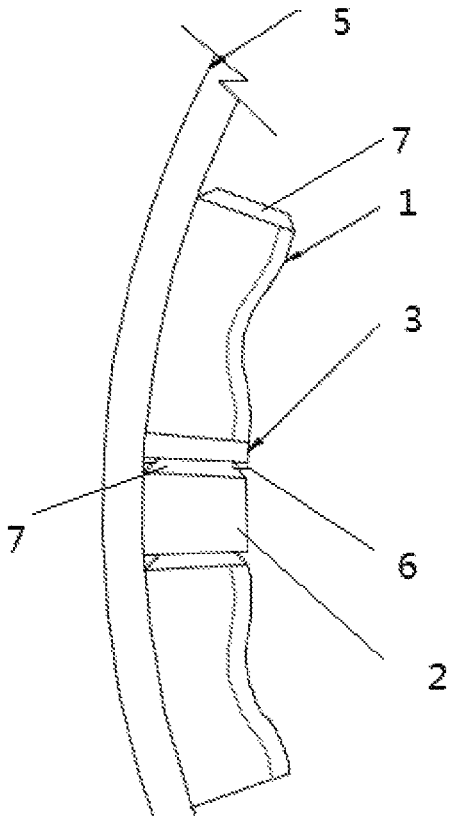
FIG. 1 is the product profile of the invention.
Figure 2:
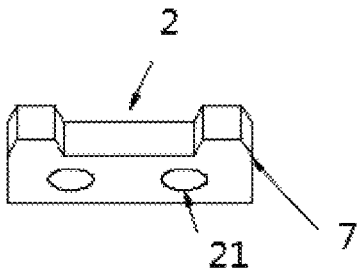
FIG. 2 is the structure diagram of the self-fixing liner.
Figure 3:
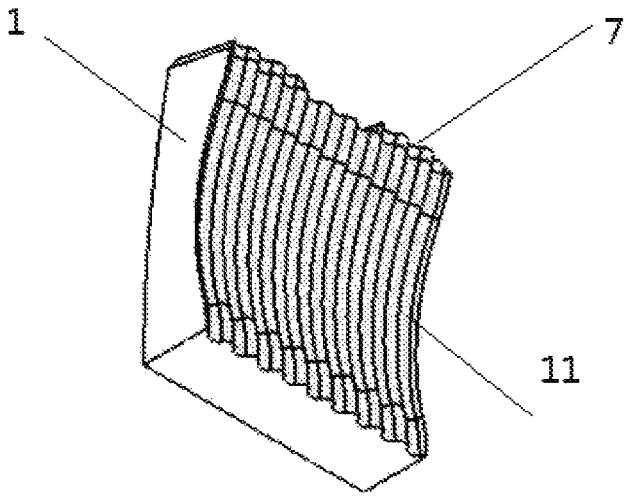
FIG. 3 is the stereoscopic structure diagram of the wear-resistant liner of the invention.
Figure 4:
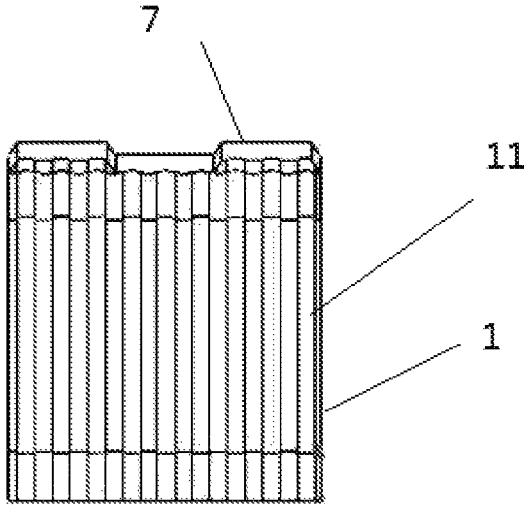
FIG. 4 is the inner side structure diagram of the wear-resistant liner.

The technical scheme of the invention is further described combined with the attached drawings, but it shall not be construed as the restriction to the invention:

FIG. 1 is the product structure diagram of the invention. A ball mill liner assembly, fitted into the ball mill drum, comprising wear-resistant liners 1, self-fixing liners 2 and installation modules 3. Combined with FIG. 3 and FIG. 4, the wear-resistant liner 1 is shaped in a circular arc adapted to the inner wall of the ball mill drum, it is integrally made of ceramic materials, the side fitted to the inner wall of the drum is a smooth surface or a hollow surface, while the other side is the working face. The working face is integrally in the shape of waves distributed along the circumference of the drum and a plurality of grooves 11 for guiding the movement of the mill balls are uniformly arranged along the axial direction of the drum; the self-fixing liner 2 is made of low-carbon alloy steel, as shown in FIG. 2, the self-fixing liner 2 may have screw holes 21, the self-fixing liner 2 is fixed onto the ball mill drum by matching the bolts and the existing screw holes of the ball mill drum, the bolts are only service bolts, the service bolt is an industry term meaning that the bolt is only used to facilitate the installation without any action on the working state of the liner, i.e., without any fastening effect after completion of installation, the bolt may be removed or reserved in the drum and operated along with the mill; a plurality of self-fixing liners 2 are fully uniformly arranged on the circumference of the ball mill drum 5 upwards at intervals, a group of wear-resistant liners 1 and installation modules 3 are filled between two adjacent self-fixing liners 2, the self-fixing liners 2 and wear-resistant liners 1 are arranged with two lug bosses 7 to form the lug boss ends at the same direction end face along the circumference of the drum, their sides opposite to the lug boss ends are planes; a side of the installation module 3 is connected with the plane end of the wear-resistant liner 1, the self-fixing liner 2 is connected with the end of the wear-resistant liner 1 with the lug boss 7, the lug boss end of the self-fixing liner 2 is fitted against the other side of the installation module 3; the wear-resistant liner 1 and the self-fixing liner 2 form two-point extrusion contact connection with each adjacent self-fixing liner 3 and installation module 3 through each lug boss end, thus enabling firm matching between the liners; a hard gasket 6 is arranged between each self-fixing liner 2 and installation module 3 through interference insertion, thus enabling adequate extrusion contact among the wear-resistant liner 1, the self-fixing liner 2 and the installation module 3 and preventing the gasket 6 of the installation module 3 from damaging the self-fixing liner 2 due to interference extrusion.

An installation method of ball mill liner assembly, comprising the following steps to:

firstly use the self-fixing liners to divide the drum into several areas properly along the circumferential direction of the ball mill drum and utilize the existing screw holes of the ball mill drum to fix the self-fixing liners;

place the wear-resistant liner 1 into the self-fixing liner division area in the ball mill drum circumferentially;

place the installation module 3 above the lug boss on the self-fixing liner 2, enabling it to contact the end of the self-fixing liner 2 with the lug boss and contact the end of the wear-resistant liner 1 without the lug loss;

insert an iron wedge into the gap between the self-fixing liner 2 and the installation module 3 and hammer the iron wedge to fasten the liners at both sides along the circumferential direction; meanwhile, insert the gasket 6 into the gap between the self-fixing liner 2 and the installation module 3 to realize tight fit among the liners in the whole area; then withdraw the iron wedge.

The benefit of the invention is as follows: the invention uses ceramic materials to replace metal, adjusts the gradation of the mill ball of the ball mill properly and enables the ceramic liner to work on the ball mill firmly and reliably. The service life of ceramic liners can reach 4-6 times of that of metal liners, which greatly improves the production efficiency of the enterprises and reduces the production costs. Since the ceramic density is only 38.5% of metal density, the weight of the whole liner only accounts for about 40% of the metal liner. Application of ceramic liners can reduce the operating energy consumption of ball mills. In the cement industry, application of ceramic materials can prevent metal pollution of metal liners and improve the quality of cement. In the production process, ceramic liners can eliminate the environmental pollution such as waste sand and exhaust arising from production of traditional metal liners, reduce the production energy consumption greatly and meanwhile avoid consumption of much metal and expensive alloy elements to a great extent. Application of ceramic materials will reduce the national environment and energy costs greatly. In addition to improving the production efficiency of the enterprise greatly, the invention will also bring huge economic benefits and save resources. The invention adopts the installation method of ball mill liner assembly to tightly fit the liners effectively and prevent the ceramic liners from breakage during pressing.

The embodiments of the invention are described in details combined with the attached drawings, but the invention is not limited to above embodiments and may have various changes within the knowledge scope of a person skilled in the art provided that such changes don't deviate from the aim of the invention.

What is claimed is:

1. A ball mill liner assembly for a drum of a ball mill, comprising a plurality of units, each of which comprises a wear-resistant liner, a self-fixing liner, an installation module, a first lug boss and a second lug boss, wherein the self-fixing liner is arranged with screw holes and configured to be fixed to the drum, wherein the wear-resistant liner is integrally made of ceramic materials, and the self-fixing liner is made of ductile materials, wherein in each of the unit one side of the installation module is in contact with one side of the first lug boss, another side of the first lug boss is in contact with one side of the self-fixing liner, another side of the self-fixing liner is in contact with one side of the second lug boss, another side of the second lug boss is in contact with one side of the wear-resistant liner to form an installation module>lug boss>self-fixing liner>lug boss>wear-resistant liner sub-assembly which is further assembled into the ball mill liner assembly fitted into a ball mill drum.

2. The ball mill liner assembly according to claim 1, further comprises a hard gasket in each of the units, wherein the hard gasket is disposed between the installation module and the first lug boss in the sub-assembly.

3. The ball mill liner assembly according to claim 1, wherein the self-fixing liner is arranged with screw holes.

4. The ball mill liner assembly according to claim 1, wherein the self-fixing liner is arranged with the first lug boss, which has oblique angles or circular arcs at both sides along the axial direction of the ball mill.

5. The ball mill liner assembly according to claim 1, wherein the installation module is made of low-carbon alloy steel or steel plates.

6. The ball mill liner assembly according to claim 1, wherein the ductile material is carbon steel or low-carbon alloy steel.

* * * * *